United States Patent [19]

Lorenz

[11] 4,255,224

[45] Mar. 10, 1981

[54] MACHINE FOR THE MANUFACTURE OF BRUSHES

[75] Inventor: Reinhold Lorenz, Voehl-Oberorke, Fed. Rep. of Germany

[73] Assignee: Schlesinger GmbH & Co. Maschinenbau KG, Frankenberg, Fed. Rep. of Germany

[21] Appl. No.: 22,118

[22] Filed: Mar. 20, 1979

[30] Foreign Application Priority Data

Mar. 23, 1978 [DE] Fed. Rep. of Germany ..... 2812746

[51] Int. Cl.[3] ..... B32B 31/12; A46D 3/04; A46B 3/06

[52] U.S. Cl. ..... 156/499; 15/159 R; 15/183; 15/192; 15/193; 156/72; 156/556; 156/567; 300/2; 300/5; 300/10; 300/21

[58] Field of Search ..... 15/159 R, 183, 192, 15/193; 156/499, 556, 567, 72; 300/2, 21, 5, 10

[56] References Cited

U.S. PATENT DOCUMENTS

| | | | |
|---|---|---|---|
| 3,596,999 | 8/1971 | Lewis | 300/21 |
| 3,604,043 | 9/1971 | Lewis | 15/159 R |
| 3,910,637 | 10/1975 | Lewis | 300/2 |
| 4,109,965 | 8/1978 | Lewis | 300/21 X |

FOREIGN PATENT DOCUMENTS 1114463 10/1961 Fed. Rep. of Germany .

*Primary Examiner*—John T. Goolkasian
*Assistant Examiner*—Robert A. Dawson
*Attorney, Agent, or Firm*—Blanchard, Flynn, Thiel, Boutell & Tanis

[57] ABSTRACT

A machine for the manufacture of brushes having at least one brush head mounting structure for brush heads. The mounting structure is pivotal about two axes and furthermore is longitudinally movable. The machine comprises a bristle bunch holder for holding bristle bunches and movement devices for guiding the bristle bunch to a brush head. Between the bunch holder and the brush head there is arranged at least two heating elements with contact heating surfaces thereon. The heating elements are provided on a movable heating-element carrier which can be moved between an engaging position, in which one heating surface is adjacent to the brush head and the other adjacent to the bunch holder, and a rest position, which lies outside of the range of movement of the bristle bunch holder.

22 Claims, 7 Drawing Figures

50a
50
60
24'
62
II 50
51
56
58
57
3'
59
49
60
61
49a
52
53a
53
53b
54
55
III
III

MACHINE FOR THE MANUFACTURE OF BRUSHES

FIELD OF THE INVENTION

This invention relates to a machine for the manufacture of brushes and, more particularly, to a machine wherein the bristle bunches are weldably secured to a brush head.

BACKGROUND OF THE INVENTION in the classic brush construction (German AUS No. 1114463), the bristle bunches are fastened by pressing them into openings of the brush head member. The bristles are bent at 180° prior to the pressing in operation and have a thin wire around them at the bent area. Bunches which are prepared in this manner are then pressed into the holes of the brush head member. The holes were earlier prepared by a drilling operation.

Machines are used for these operations, with which brush head members can be rotated into any desired positions, so that openings of any desired direction can be provided in the brush head member and pushingin elements for pressing in of the bunches can each be aligned to the axis of the receiving opening. A machine of this type is illustrated in the aforesaid German AUS No. 1114463, in which a turret rotates about a vertical axis. Such machines can, however, also be built with turrets which are rotatable about horizontal axes. Any type of brush shapes can be manufactured with these machines, wherein the brush head can also have a curved bristle-lined surface and the bristle bunches can have any desired directions, so that any desired angular dispersion can be manufactured. This is an important advantage because for many brushes a lateral projection of the bristles beyond the lateral edges of the brush head is desired so that the bristles will reach into corners, which would otherwise be prevented by the brush head contacting a wall surface. At this point it is remarked that the term brushes is not only to include brushes in the more narrow sense, namely relatively short-bristle articles with relatively stiff bristles, but also other articles, as for example brooms and whisk brooms.

The classic brush construction requires a brush head, which is sufficiently thick that the openings which are needed for pressing in of the bunches can be manufactured with the necessary depth, for which reason the brush heads are relatively thick parts. The areas in which the bristles engage the holes are not accessible. Germs and other contaminants can settle therein, which raises doubt with respect to hygiene, for example, where brushes are to be used for creating conditions as sterile as possible, for example in hospitals.

Brushes have also become known lately in which bristles consisting of a thermoplastic plastic material are welded to a brush head which also consists of a thermoplastic material. For the manufacture of such brushes, machines are used (see for example U.S. Pat. No. 3,604,043) which have a bristle magazine, in which bristles, which are cut to length, are stacked. Holes are provided in the magazine wall for receiving small tubes therein, which small tubes are mounted on a bunch holder and are filled with bristles when inserted into the magazine. The ends of the bristle bunches are then pressed against a heating plate and are warmed up until the bristles melt together. The brush head which consists of thermoplastic material is also melted at each desired fastening point and several bristle bunches are simultaneously welded to the brush head. The brush head has a flat bristle-lined surface.

Such brushes have the advantage that openings for engagement by the bristle bunches are not required, so that the brush head can be constructed relatively thin. Also depressions do not exist for the collection of contaminants. It is disadvantageous that machines do not exist which permit the manufacture of brushes of any desired shape, thus for example of brushes with a fanned bristle bunch arrangement, in which the angle of inclination differs from bristle bunch to bristle bunch.

The basic purpose of the invention is to provide a machine which permits a manufacture of brushes with bristle bunches which are welded to the brush head, which have just like in the classic brush construction any desired shape, wherein also any desired direction of the bristle bunches is possible.

The attainment of this purpose is based on a conventional (German Pat. No. 1114463) machine for the manufacture of brushes wherein at least one brush head mounting structure for brush heads is provided, which mounting structure is pivotal about two axes, and furthermore is longitudinally movable. The machine includes a bristle bunch holder for gripping of bristle bunches and which is movable for supplying the bristle bunch to a brush head. Such a machine is characterized inventively by arranging at least two heating elements with contact heating surfaces thereon between the bunch holder and the brush head mounting structure, which are provided on a movable heating-element carrier movable between an engaging position in which one heating surface is adjacent to the brush head and the other adjacent to the bunch holder, and a rest position, which lies outside of the range of movement of the bunch holder.

The brush member can be swung with such a machine just like with the classic brush manufacturing machines into any desired position. The brush head is now melted at the desired location with a heating element, while at the same time the other heating element melts a bristle bunch at its end. After swinging out of the heating elements from the area between the brush head and bristle bunch, the bristle bunch is guided to the brush head and is welded to same. During the creation of the contact between the bristle bunch and the brush head, the places which had been warmed up earlier with the heating elements are still in a tacky condition. After welding of the bristle bunch to the brush head, the bunch holder returns into its initial position, the brush head is swung into a new position and the heating elements are swung between the bristle bunch holder and the brush head, after which the described operations are repeated.

The invention brings about the advantage that it is now also possible to manufacture brushes with bristle bunches weldably secured thereto in any desired overall shape so that the advantages of classic brushes, namely their advantageous overall shapes are related to the advantages of brushes with bristles welded to the brush head, namely thin brush heads can be used and the more advantageous hygienically maintainable brushes are obtained. Also the process of drilling bristle-fastening holes is no longer necessary.

It is preferable to arrange the two heating elements on one heating piece, because then only one movement device is needed for the heating elements. However, embodiments are also part of the invention in which two separate heating elements with separate movement devices are used. The movement devices for the heating-element carrier can be pivotally mounted on a frame for the aforesaid movement, even though other movement devices can also be used. Thus the movement and pulling back of the heating-element carrier could also take place along a rectilinear guideway.

It is also an object of this invention to provide an arrangement of a bristle magazine from which the bristles are inserted into small tubes, as this is actually known from the state of the art. However, it is also possible to weld bristles which are bent at 180° to a brush head. The removal of the bristles from the magazine can, as is actually known, occur by introducing the small tube into the magazine. However, it is also possible according to the invention to secure a small tube on the magazine, into which small tube bristles are pushed by a plunger.

Various other embodiments are possible for the invention. One embodiment includes a movably arranged bristle magazine. Of course, not all objectives need to be simultaneously realized in this embodiment. For example, in place of cam plate gearing driving the magazine carriage for movement, it would also be possible to use fluid pressure power cylinders for the movement thereof. The use of a magazine having several compartments provides a means of selection, namely, permitting the use of several bristle types on one brush, for example hard and soft bristles or bristles of differing colors. With this type of magazine, it is also possible to provide bristle bunches of differing thicknesses. The size of the bunch is determined by the plunger diameter and the small tube diameter. The plunger and the small tube can be easily exchanged.

A further embodiment in which bristles can be processed from a spool is also possible. Such an embodiment has naturally no bristle magazine with bristles stored therein and which are cut to length. This embodiment has the advantage that the operation of cutting to length away from the machine is omitted.

The parallel arrangement of several brush head mounting structures has the advantage that the output of the machine is increased, namely, by a factor which equals the number of the parallel arranged brush head mounting structures, etc. It must be remarked here, that the heating up and welding of a bristle bunch to a brush head takes more time than pushing a bristle bunch into a hole. This disadvantage is partly cancelled by the time it takes to drill the holes in the brush head, which step is deleted, however, the time for the drilling of a hole and the pushing in of a bristle bunch together is still shorter than the time for heating up and welding of a bristle bunch to the brush head. The output of an inventive machine can, however, be achieved in a desired degree by the described parallel arrangement of brush heads and bristle bunch holders.

The method of operation has the advantage that the heated-up locations on the brush head and on the bristle bunch can contact one another in as short a time as possible after the heating-up procedure. However, due to the material character a certain phase shifting between the heating up of the brush head and the heating up of the bristle bunch can also be preferable. It is also possible to use different time intervals for contact between the one heating element and the brush head and for contact between the other heating element and the bristle bunch.

BRIEF DESCRIPTION OF THE DRAWINGS

Exemplary embodiments of the invention are illustrated in the drawings, in which.

DETAILED DESCRIPTION

Figure 1:
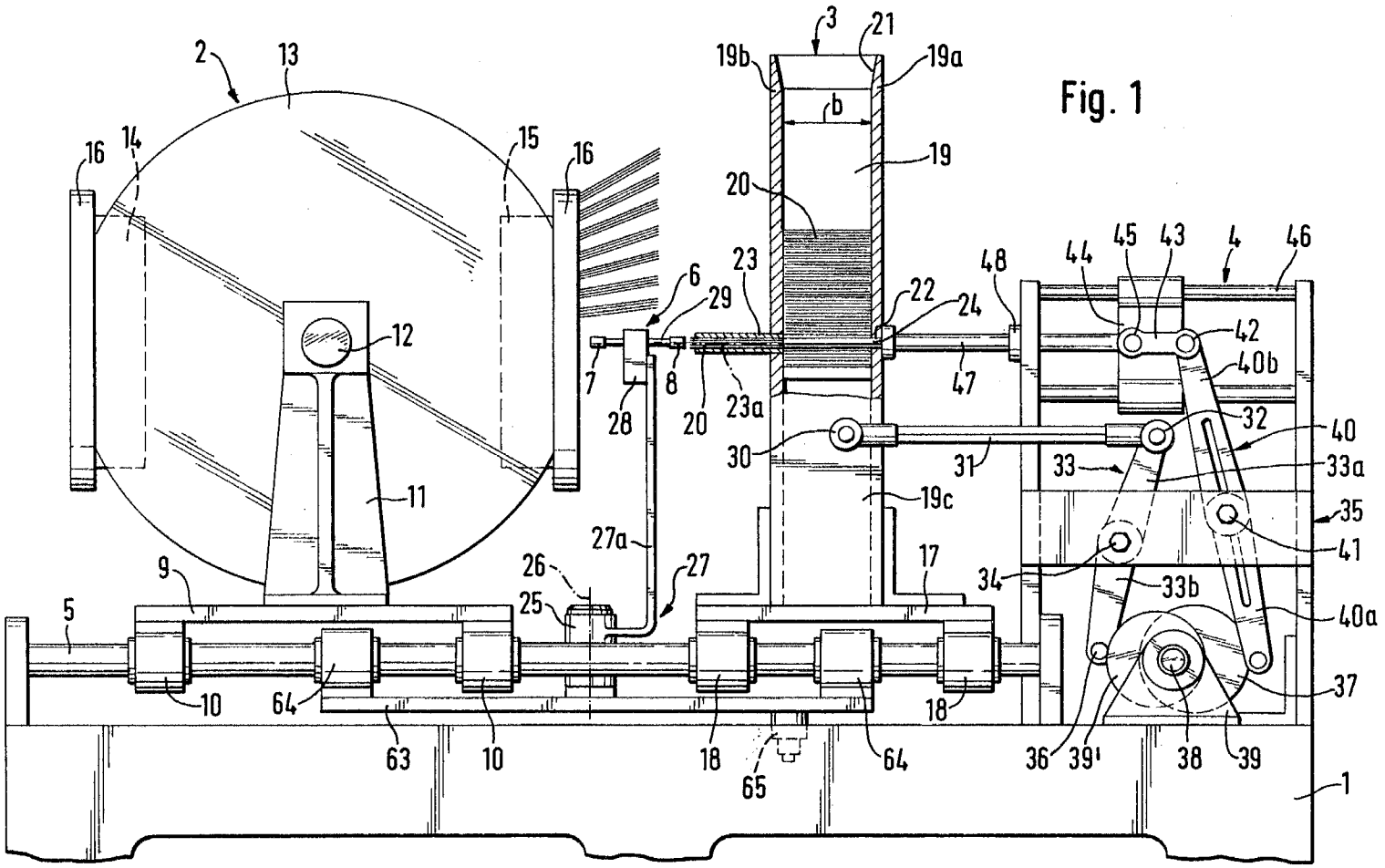
FIG. 1 is a partial side view and a partial vertical cross-sectional view of a machine having a movable bristle magazine.

The machine according to FIG. 1 has a frame 1, of which only the upper area is illustrated. A turret 2 with several brush head mounting structures thereon, a bristle magazine 3 and a drive mechanism identified as a whole by the reference numeral 4, are arranged on the machine frame 1. The turret 2 and the bristle magazine 3 are movable along a pair of parallel guide rods 5 which are secured to the frame 1. A further important element of the machine is a heating-element carrier 6 having heating elements 7 and 8. The mentioned main parts will be discussed individually hereinbelow.

The turret 2 is arranged on a carriage 9, on which all together four guide sleeves 10 are provided, which are slidable on the guide rods 5. Bearing blocks 11 extend upwardly from the carriage 9, in which bearing blocks is supported a shaft 12 of the turret 13.

Figure 5:
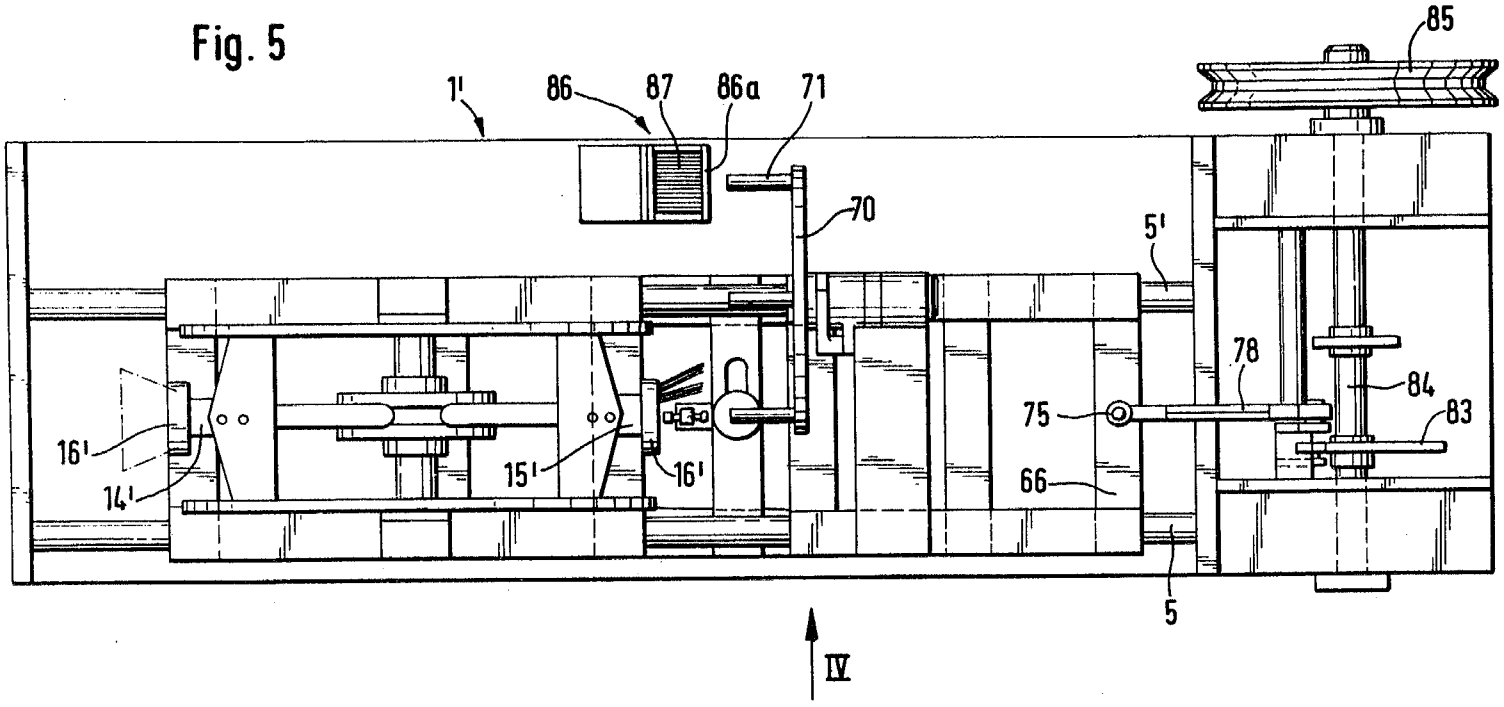
FIG. 5 is a top view corresponding with the line V of FIG. 4.

A mounting structure or brush head holder 14, 15 for the brush heads 16 is provided on the turret. The mounting structure 14 and 15 can both be moved vertically and also can be pivoted about two axes which are at a right angle with respect to one another, which is illustrated in FIG. 5. We deal here with a technique which is actually known in brush making machines.

Several mountings 14 and 15 are preferably arranged side-by-side at a right angle with respect to the drawing plane for FIG. 1.

The brush magazine 3 is arranged on a carriage 17, on which four guide sleeves 18 are provided, which are also movable along the guide rods 5. A hopper 19 extends upwardly from the carriage 17 for receiving bristles 20 therein which have been cut to length. The width b of the hopper 19 equals the length of the bristles. The hopper has an enlarged portion 21 at the upper end, which portion makes the placement of the bristles into the hopper 19 easier.

An opening 22 exists in the wall 19*a* of the magazine hopper. A small tube 23 is secured on the opposite wall 19*b*, which small tube is in axial alignment with the opening 22. A plunger 24 is received in the opening 22, the axis of which plunger is in alignment with the axes of the small tube 23 and naturally the opening 22.

A further carriage 63 is movably supported by means of guide sleeves 64 on the rods 5. A pivot 65 is provided on the carriage 63 for the connection to a push rod which, however, is not illustrated in the drawings. A member 25 is rotatably supported on the carriage 63 about the axis 26. The rotatable driving device which is used to rotate the member 25 is not illustrated in the drawing. An arm 27 projects from the member 25 and has an upwardly projecting section *27a*, at the end of which is secured a holder 28 for a heating rod 29. The ends of the heating rod 29 form the heating elements 7, 8. The axis of the heating rod 29 is axially aligned with respect to the axis *23a* of the small tube 23.

A push rod 31 engages the wall 19*c* of the magazine hopper at 30, which push rod is pivotally connected at 32 to one arm *33a* of a two-arm lever 33. The two-arm lever 33 is pivotally supported at 34 on a frame 35 supporting the elements of the drive mechanism 4. The other arm *33b* has a feeler roll 36 thereon which engages a cam 39' rotatably supported on a shaft 38. The shaft 38 is rotatably supported in bearing blocks 39 which are secured to the frame 1.

An arm *40a* of a two-arm lever 40 engages a further cam 37, which is positioned on the shaft 38, which two-arm lever 40 is also pivotally supported on the frame 35. A connecting plate 43 is pivotally connected as at 42 to the other arm *40b* of the lever 40. The connecting plate extends to a carriage 44, to which it is pivotally connected at 45. The carriage 44 is slidable on guide rods 46 and is connected to a push rod 47, which is slidably supported in a guide sleeve 48. The already mentioned plunger 24 is secured to the front end of the push rod 47.

The machine operates as follows:

FIG. 1 illustrates a position in which the heating rod 29 is provided between the brush head 16 and the small tube 23. The small tube is filled with bristles 20, which are pushed into the small tube by the plunger 24 and a cyclical operation of the drive mechanism. The bristles project slightly beyond the left end (FIG. 1) of the small tube 23.

After the small tube 23 is filled with bristles, simultaneously the heated heating element 7, which is on the left side of the holder 28 (FIG. 1) contacts the brush head 16 caused by a moving of the carriage 63 by the drive mechanism 4 to the left to melt a small portion thereof and the bristle bunch which is provided in the small tube 23 contacts the heating element 8 caused by a moving of the magazine carriage to the left by the drive mechanism 4 to melt a small portion thereof.

The location to which the bristles are to be attached to the brush head 16, which consists of thermoplastic material, is melted by this procedure. The ends of the bristles 20, which project from the small tube 23, are at the same time melted by this procedure. The heating elements are thereafter slightly removed from the melted locations, which can be done in various ways, for example by slightly moving the bristle magazine and slightly moving the carriage 63. Alternatively, one could also slightly move the turret with the brush head mounting structure thereon. Also possible is a pulling back of the heating elements, which could then for example be telescopically constructed. After removing the heating elements from the melted locations, the member 25 and arm 27 is swung outwardly at a certain angle, for example at 90°, so that the two heating elements 7 and 8 come out of the area between the small tube 23 and the brush head 16. The bristle magazine 3 is now moved forwardly by the cam 39' through the lever 33 and the push rod 31 until the melted, still tacky ends of the bristle bunch contact the melted point on the brush head. The bristle bunch is hereby welded to the brush head 16. During the following pulling back of the bristle magazine 3, the bristle bunch remains adhered to the brush head 16, so that the small tube 23 can be pulled off from the bristle bunch.

The mounting structure 15 for the brush head carries now out such movements that the next fastening point for a bristle bunch is aligned with respect to the small tube 23. Simultaneously therewith or also thereafter, the arm 27 and the heating rod 29 thereon is again swung between brush head and the small tube 23. The plunger 24 moves a further bristle bunch into the small tube 23 and the described operation is repeated.

Since the melting procedure and the welding or attachment procedure does require a certain amount of time, it is preferable to simultaneously weld bristle bunches to several brush heads. The turret 13 can for this purpose be constructed relatively long, viewed at a right angle with respect to the drawing plane for FIG. 1, and several brush head mounting structures 15 can be arranged side-by-side. The movement of all of these mountings can be effected from the same drive mechanism 4.

When the brush head 16 is completely occupied with bristles, the turret 13 is swung 180°, after which a new bristleless brush head 16 reaches the welding station. The finished brush is then removed and is replaced with a new bristleless brush head.

A brush is illustrated in the drawing, in which the angle of inclination of the bristle bunch differs from bunch to bunch. This arrangement is possible with the inventive machine. The inclined position is also different in the rows which extend at a right angle with respect to the drawing plane for FIG. 1. This can be achieved also in flat brush heads. However, one will often use in this case arced brush heads. At any rate, the inventive machine permits the manufacture of any kind of brush shape.

Figure 3:
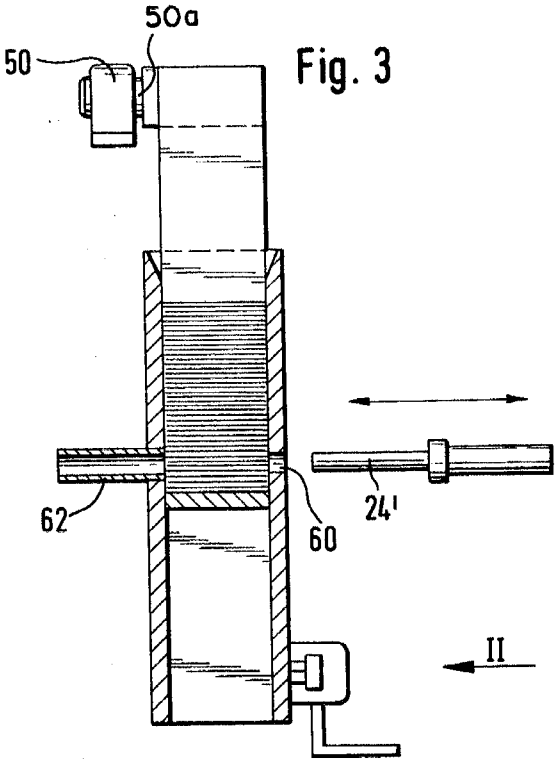
FIG. 3 is a cross-sectional view taken along the line III—III of FIG. 2.
Figure 2:
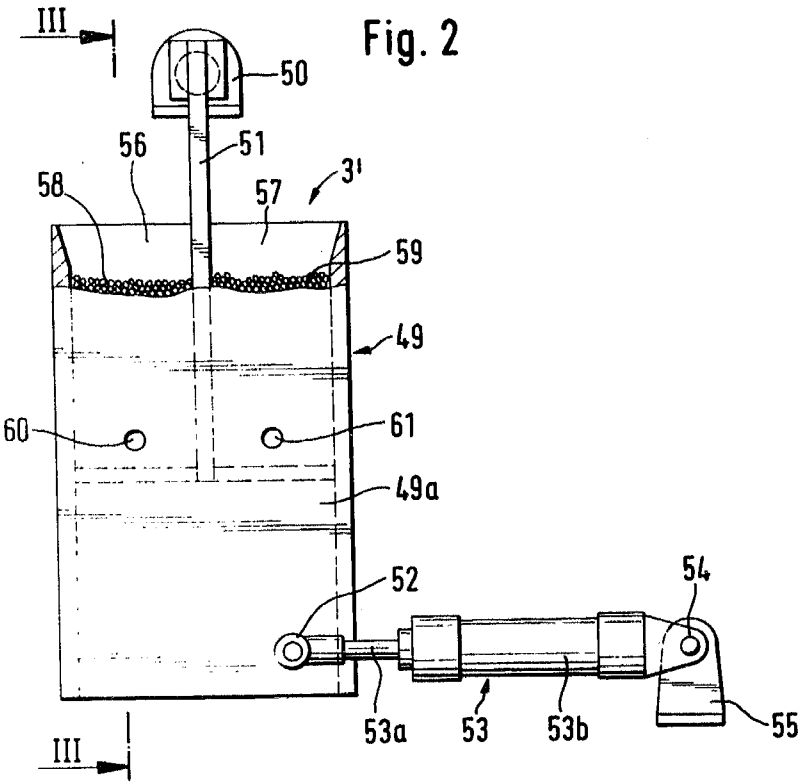
FIG. 2 is a side view of a bristle magazine, which can be used in a machine according to FIG. 1.

In the modification illustrated in FIGS. 2 and 3, the brush magazine which is here identified as a whole by the reference numeral 3' is not only movable in a direction toward the brush head, but also at a right angle to said direction. A box 49 is for this purpose suspended on a swivel bearing 50. An axle 50A projects sidewardly from the swivel bearing 50. A suspended plate 51 is connected to the axle 50A and the box 49 is secured to the lower end of the suspended plate 51. A piston rod *53a* of a power cylinder which is identified as a whole by the reference numeral 53 is pivotally connected at 52 to the sidewall *49a* of the box, the cylinder portion *53b* of which cylinder being pivotally connected at 54 to a bracket 55, which can be secured for example on the carriage 17 according to FIG. 1. The swivel bearing 50 could also be fixedly mounted on the carriage 17.

The suspended plate 51 forms at the same time a partition between two compartments 56 and 57 in the box 49. Various bristle types are supported in the compartments, for example hard bristles 58 and soft bristles 59. Various bristle colors are also often used.

An opening 60 or 61 is associated with each compartment 56 and 57, which opening corresponds with the opening 22 according to FIG. 1. A small tube is arranged opposite each opening. FIG. 3 shows the small tube 62 which is opposite the opening 60.

With the aid of the cylinder 23 the opening 60 or the opening 61 can be selectively axially aligned with a plunger 24', which corresponds with the plunger 24 of FIG. 1.

By suitably adjusting the box 49, either bristles 58 or bristles 59 can be welded to the brush head.

Alternative with respect to the shown exemplary embodiment, it is also possible for the plunger to slide in a guideway which is connected to the magazine. The plunger is then not fixedly connected to the plunger push rod, as this is illustrated in FIGS. 1 and 3. Instead, the pugh rod presses onto the plunger which is supported on the magazine, which is aligned with respect to the push rod.

Figure 4:
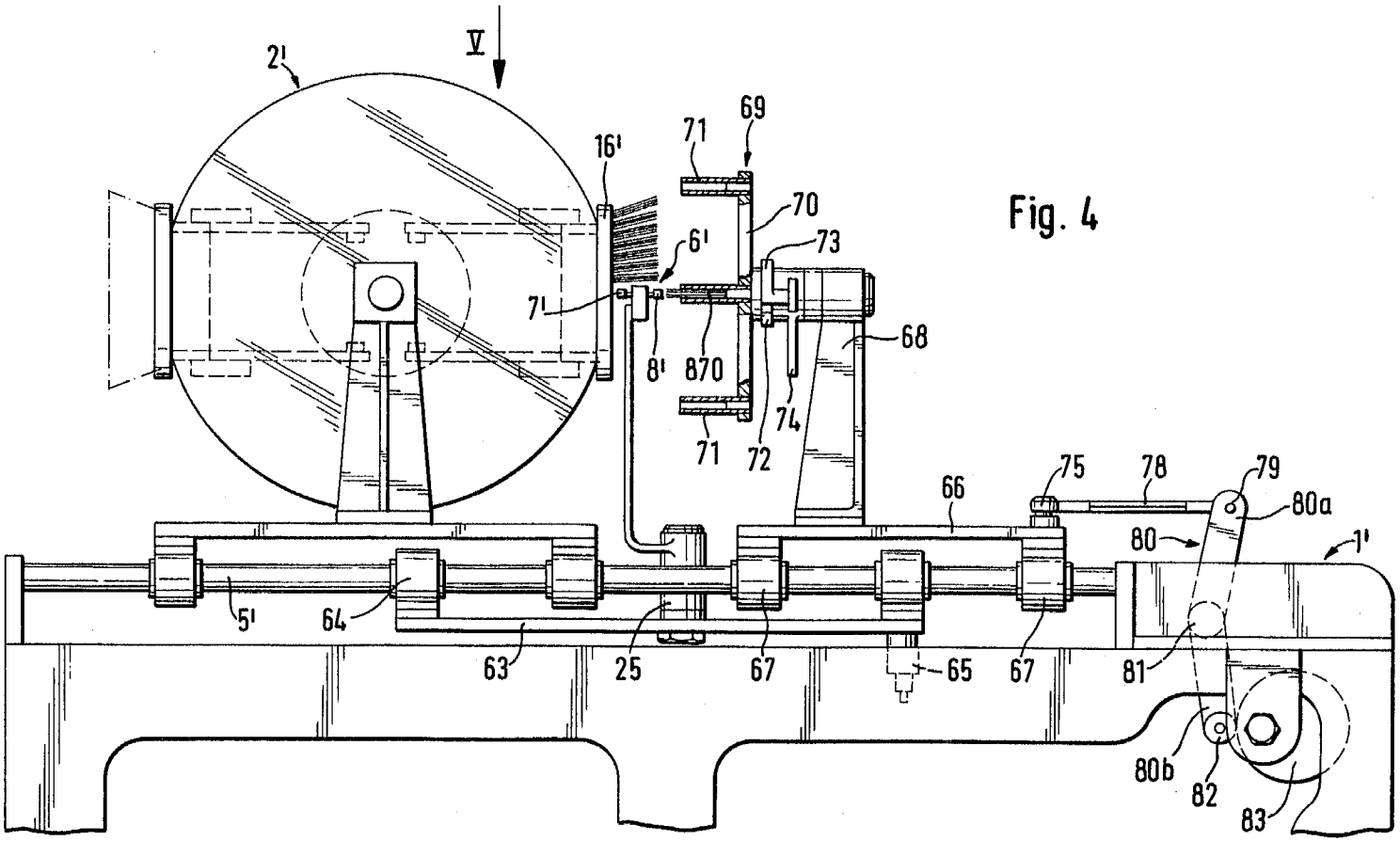
FIG. 4 is a side view of a machine having a stationarily arranged bristle magazine.

The machine according to FIGS. 4 and 5 also has a turret which is here as a whole identified by the reference numeral 2' and which is constructed and is supported in the same manner as the turret 2 according to FIG. 1.

A heating-element holder having heating elements 7' and 8', which holder is identified as a whole by the reference numeral 6', exists also again. The heatingelement holder is again arranged on a rotatably supported member 25'. The member 25', however, is provided on a separate carriage 63, which is movably supported by means of four guide sleeves 64 on guide rods 5'. A pivot 65 for the connection to a push rod, which, however, is not illustrated in the drawings, is provided on the carriage 63.

A further carriage 66 having guide sleeves 67 thereon is movable along the guide rods 5'. A bearing block 68 extends upwardly from the carriage 66, on which bearing block is rotatably supported a turret which as a whole is identified by the reference numeral 69. The turret 69 includes a plate 70 thereon, on which all together four small tubes 71 are secured and project in direction of the brush head 16'. The small tubes 71 are angularly spaced at 90° with respect to one another.

The plate 70 is positioned on a shaft, with which is fixedly connected a ratchet wheel 72. A ratchet 73 cooperates with a ratchet wheel 72, which ratchet 73 is movable by means of a drive lever 74. The plate 70 can be rotated step-by-step through 90° intervals with the aid of the ratchet mechanism.

A push rod 78 engages at one end and at 75 the carriage 66, which push rod is pivotally connected at 79 to the arm **80*a* of a two-arm lever 80. The lever 80 is pivotally supported at 81 on the machine table 1'. The other arm 80*b* carries a feeler roll 82, which cooperates with a cam 83, which (see here also FIG. 5) is mounted on a shaft 84. The shaft 84 is driven for rotation by a V-belt, for example, connected to a V-belt pulley 85** on the shaft.

A bristle magazine 86 is stationarily arranged on the machine table 1' and is filled with bristles 87. The position of the magazine is side-by-side with the brush head supporting the turret 2'. The small tubes 71 on the plate 70 are angularly spaced so that simultaneously one small tube 71 is aligned with respect to the bristle magazine 87 and another small tube is aligned with respect to the brush head 16', when the plate 70 is in one of its locked positions. The two other small tubes 71 do not have any operating function in this stage. These two functionless small tubes reach after a further rotation of 90° the aforesaid operating position.

One will recognize from the view of FIG. 5, and as stated above, the mounting structure 14' and 15' for the brush heads 16' are swingably supported. A description of details for this is not required since such supports and drives are known in classic brush making machines, for example from German Pat. No. 1114463.

The machine according to FIGS. 4 and 5 operates as follows:

Starting out from the illustrated position, the heating elements 7' and 8' contact in the same manner the brush head 16' or the end of a bristle bunch 870, as this was described already with reference to FIG. 1. After the heating elements are swung out of the way about the axis of the member 25, the carriage 66 is moved forwardly, wherein at the same time welding of the earlier melted bristle bunch 870 to the brush head 16' and the removal of a bristle bunch from the magazine 86 occurs. In addition, and during movement of the carriage 66, the small pipe 71, which is aligned with a corresponding opening in the wall **86*a* of the magazine 86, also penetrates into the magazine and is thereby filled with bristles 87**.

After welding of a bristle bunch to a brush head, the carriage 66 is pulled or retracted back, wherein the small tube 71 is pulled away from the welded bristle bunch and at the same time a small tube which is filled with bristles is pulled out of the magazine 86. After this a rotation of 90° of the turret 69 takes place and a small tube which is filled with bristles reaches the welding station. If one conceives that in FIG. 4, viewed from the right, the turret rotates clockwise, the lowermost small pipe 71 is filled with bristles, while the uppermost small pipe 71 is empty. If the movement would occur counterclockwise, then the uppermost small tube 71 would be filled with bristles, while the lowermost small tube would be empty.

The manufacture of any desired brush shape is possible also with the machine according to FIGS. 4 and 5.

Figure 7:
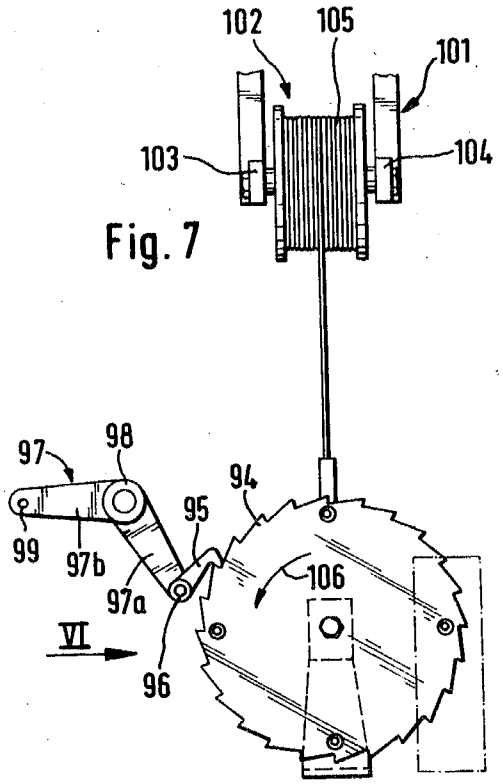
FIG. 7 is a view of the elements according to FIG. 6 in direction of the arrow VII of FIG. 6.
Figure 6:
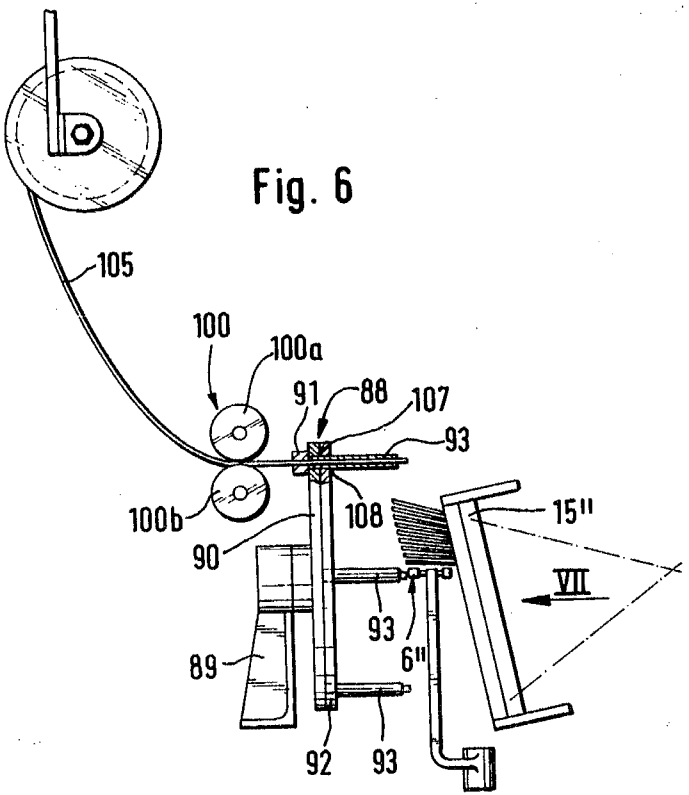
FIG. 6 is a side view of elements of a machine with the supply of bristles from a storage roll.

The embodiment according to FIGS. 6 and 7 is only partly illustrated. Part of this machine also includes a turret with brush head mounting structure corresponding with the brush head mounting structure 14, 15 or 14', 15'. Such a mounting structure, which is identified by the reference numeral 15'', is illustrated isolated in FIG. 6. The also isolated illustration of the heating-element holder 6'' is supported in the same manner as is described with reference to FIGS. 4 and 5. In addition, the machine according to FIGS. 6 and 7 has a turret, which is here identified as a whole by the reference numeral 88. The turret 88 is supported on a bearing block 89, which is provided in turn on a carriage corresponding with the carriage 66 according to FIG. 4.

The turret 88 includes a stationary plate 90, on which is arranged an inlet nozzle 91. A plate 92 rests on the plate 90, which plate 92 is rotatable, and on which plate 92 are provided small tubes 93, namely four small tubes, which are angularly spaced from each other at 90° with respect to one another.

A tooth system consisting of saw-tooth-shaped teeth 94 is arranged on the periphery of the plate 92, which cooperates with a transport pawl 95. The transport pawl 95 ia pivotally supported at 96 on a lever arm **97*a* of a two-arm lever 97. The lever 97 is pivotally supported at 98. The bearing 98 is preferably rigidly connected to the bearing block 89. A pivot 99 for a rod which is not illustrated is provided on the other lever arm 97*b* for pivoting the lever 97**.

A drive roller system 100 consisting of transport rollers **100*a* and 100*b* is arranged in front of the inlet nozzle 91. The transport roller pair 100 is fixedly arranged relative to the stationary plate 90**.

A mounting for a storage spool 102, which mounting is identified as a whole by the reference numeral 101, is furthermore part of the machine. The storage spool is rotatably supported in bearings 103 and 104. Bristle material 105 is stored on the storage spool, preferably a strand of several parallel fibers.

The machine according to FIGS. 6 and 7 operates as follows:

The movement of the heating-element carrier 6'' and of the turret 88 occurs as this has already been described with reference to FIGS. 4 and 5. The difference from the embodiment according to FIGS. 4 and 5 consists only in the filling of the small tube 93 with bristles. This filling is done by the transport rollers 100*a* and 100*b* being moved step-by-step and thereby moving the bristle strand 105 for the length of a bristle bunch. The bristle material strand is hereby moved forward through the inlet nozzle 91 and the respective small tube 93, which is aligned therewith, until the front end of the strand projects from the small tube.

The plate 92 is now rotated 90° in direction of the arrow 106 (see FIG. 7). The edges 107 of the opening of the inlet nozzle and 108 of the adjacent opening in the small tube 93 act as cutting edges, which cut off the strand 105. After two further rotary steps of the plate 92 the bristle bunch reaches the welding position and is welded to the brush head as this has already been described with reference to FIGS. 4 and 5.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for the manufacture of brushes having at least one brush head mounting structure and a bristle bunch holder for holding bristle bunches, and means for guiding at least one of said bristle bunch holder and said brush head mounting structure for relative movement toward and away from each other, the improvement comprising a movable heating-element carrier on which is mounted at least two heating elements, said two heating elements being arranged between said bristle bunch holder and said brush head mounting structure with each heating element having a contact heating surface, said movable heating-element carrier being movable between a first engaging position, in which one heating surface engages a brush head on said brush head mounting structure, a second engaging position, in which the other heating surface engages ends on the bristles in said bristle bunch holder, and a rest position, which lies outside of the range of relative movement between said bristle bunch holder and said brush head mounting structure.

2. The machine according to claim 1, wherein both of said heating elements are formed by opposite ends of a heating rod mounted on said movable heating-element carrier.

3. The machine according to claim 2, wherein said movable heating-element carrier is pivotal about a pivot axis and said heating rod is arranged spaced form said pivot axis.

4. The machine according to claim 1, including a bristle magazine for housing straight bristles therein which are cut to a specified length, wherein in at least one wall of said bristle magazine there is provided a magazine opening for receiving bristles therethrough, wherein said bristle bunch holder is constructed as a small tube which receives the bristles therein.

5. The machine according to claim 4, wherein said small tube is secured on a sidewall of said bristle magazine and wherein in the oppositely positioned sidewall there is arranged an opening which is in axial alignment with said small tube and receives a plunger therethrough.

6. The machine according to claim 5, wherein said bristle magazine is secured on a magazine carriage, which is movable toward and away from said brush head mounting structure.

7. The machine according to claim 5, including a plunger drive means and a magazine carriage drive means which are related to one another, wherein said plunger ejects bristles from said bristle magazine into said small tube when said magazine carriage is oriented away from said brush head mounting structure and only after the ejection of bristles is the magazine carriage moved toward said brush head mounting structure.

8. The machine according to claim 7, wherein rotatable control cams are provided for driving said magazine carriage and driving said plunger, which control cams are mounted on the same shaft.

9. The machine according to claim 7, wherein said heating-element carrier is separate from said magazine carriage and can be moved independently of said magazine carriage.

10. The machine according to claim 9, wherein said bristle magazine has several compartments for holding various bristle types, and at each compartment there is arranged a small tube and an aligned plunger opening and wherein said bristle magazine is movable in such a manner that selectively one of said plunger openings is aligned with respect to said plunger.

11. The machine according to claim 10, wherein said bristle magazine is pivotally suspended and is swingable by drive means engaging said bristle magazine.

12. The machine according to claim 4, wherein said bristle magazine is arranged outside of the area between said brush head mounting structure and said bristle bunch holder and wherein said small tube is secured on a movable small tube carrier, which with said small tube is aligned to both said magazine opening on said bristle magazine and said brush head mounting structure, said small tube carrier being also movable in direction of the axis of said small tube.

13. The machine according to claim 12, wherein said small tube carrier is constructed as a step-by-step rotatable turret, on which several of said small tubes are provided, said small tubes being arranged such that during each indexed position of said turret, one of said tubes is sequentially aligned with respect to said magazine opening and another small tube is sequentially aligned with respect to said brush head mounting structure.

14. The machine according to claim 12, wherein said small tube carrier and said heating-element carrier are each arranged on a carriage.

15. The machine according to claim 1, including mounting means for at least one bristle material holding spool, feed elements for the bristle material, at least one small tube, which serves as a bristle bunch holder and which is positioned on a small tube carrier, said small tube carrier being movable in axial direction of said small tube toward and away from said brush head mounting structure and a cutter for cutting said bristle material which is advanced into said small tube from said spool.

16. The machine according to claim 15, wherein said cutter has parts which lie closely together, wherein an inlet nozzle for bristle material is arranged on one of these parts and said small tube is arranged on the other part, said small tube being aligned with respect to said inlet nozzle and the mutually adjacent edges of the opening of said inlet nozzles and said small tube are constructed as cutting edges.

17. The machine according to claim 16, wherein said other part is constructed as a rotatable turret which is rotatably driven step-by-step by means of a ratchet mechanism, on which turret are arranged several small tubes, so that during each locked position of said turret, one of said small tubes is aligned with respect to said inlet nozzle and another of said small tubes is aligned with respect to said brush head mounting structure.

18. The machine according to claim 1, wherein several brush head mounting structures are arranged side-by-side, wherein heating elements are associated with each side-by-side mounting structure and said heating-element carriers, said bristle bunch holders and said brush head mounting structures are movable by means of common drives.

19. The machine according to claim 1, wherein said brush head mounting structure includes a brush head holder pivotally secured to said mounting structure for movement about two pivot axes to facilitate multiple orientations of said brush head relative to the direction of relative movement between said brush head mounting structure and said bristle bunch holder.

20. The machine according to claim 1, wherein said first and second engaging positions are the same and wherein both of said two heating elements simultaneously contact said brush head and said ends of said bristles in said bristle bunch holder.

21. In a machine for the manufacture of brushes having at least one brush head mounting structure and a bristle bunch holder for holding bristle bunches, and means for guiding at least one of said bristle bunch holder and said brush head mounting structure for relative movement toward and away from each other, the improvement comprising a movable heating-element carrier on which is mounted a heating element means, said heating element means being arranged between said bristle bunch holder and said brush head mounting structure, said heating element means having a contact heating surface means, said movable heating-element carrier being movable between a first engaging position, in which said heating surface means engages a brush head on said brush head mounting structure, a second engaging position, in which said heating surface means engages ends on the bristles in said bristle bunch holder, and a rest position, which lies outside of the range of relative movement between said bristle bunch holder and said brush head mounting structure.

22. The machine according to claim 21, wherein said first and second engaging positions are the same and wherein said heating surface means simultaneously engages said brush head and said ends of said bristles in said bristle bunch holder.

* * * * *